US006648617B2

(12) United States Patent
Süss et al.

(10) Patent No.: US 6,648,617 B2
(45) Date of Patent: Nov. 18, 2003

(54) METHOD AND SCROLL COMPRESSOR FOR COMPRESSING A COMPRESSIBLE MEDIUM

(75) Inventors: Jürgen Süss, Augustenborg (DE); Leonid Paramonov, Odense (DE)

(73) Assignee: Danfoss A/S, Nordborg (DK)

( * ) Notice: Subject to any disclaimer, the term of this patent is extended or adjusted under 35 U.S.C. 154(b) by 0 days.

(21) Appl. No.: 10/056,748

(22) Filed: Jan. 24, 2002

(65) Prior Publication Data

US 2002/0102171 A1 Aug. 1, 2002

(30) Foreign Application Priority Data

Jan. 27, 2001 (DE) ..... 101 03 775

(51) Int. Cl.[7] ..... F01C 2/00
(52) U.S. Cl. ..... 418/1; 418/552
(58) Field of Search ..... 418/55.2, 1

(56) References Cited

U.S. PATENT DOCUMENTS

| | | | | |
|---|---|---|---|---|
| 3,884,599 A | | 5/1975 | Young et al. | |
| 4,527,964 A | | 7/1985 | Mitsui et al. | |
| 4,781,549 A | | 11/1988 | Caillat | |
| 5,318,424 A | | 6/1994 | Bush et al. | |
| 5,547,353 A | | 8/1996 | Yamaguchi et al. | |
| 5,836,752 A | * | 11/1998 | Calhoun et al. | 418/55.2 |
| 5,938,417 A | | 8/1999 | Takao et al. | |
| 6,099,279 A | | 8/2000 | Kohsokabe et al. | |
| 6,220,840 B1 | * | 4/2001 | Calhoun et al. | 418/55.2 |

FOREIGN PATENT DOCUMENTS

| | | | | |
|---|---|---|---|---|
| DE | 42 15 038 A1 | | 11/1993 | |
| DE | 296 03 280 U1 | | 5/1996 | |
| DE | 196 03 110 A1 | | 5/1997 | |
| EP | 0 069 531 | | 1/1983 | |
| JP | 55109792 A | * | 8/1980 | F04C/18/02 |
| JP | 60132085 A | * | 7/1985 | F04C/18/02 |
| JP | 03061686 A | * | 3/1991 | F04C/18/02 |
| JP | 04054202 A | * | 2/1992 | F01C/1/02 |

OTHER PUBLICATIONS

Harald Kaiser, Nürtingen, "Der Scroll von Bock", Die Kalte und Klimatechnik, Jun./1993. (English Summary).

* cited by examiner

*Primary Examiner*—Thomas Denion
*Assistant Examiner*—Theresa Trieu
(74) *Attorney, Agent, or Firm*—McCormick, Paulding & Huber LLP

(57) ABSTRACT

The invention relates to a method for compressing a compressible medium, in which at least two displacement elements, each having at least one limiting face extending helically in the cross section, are orbited in relation to each other under formation of at least one chamber, the volume of the chamber being changed by the orbiting movement, performing a cycle with a suction phase, a compression phase and a discharge phase, the chamber being opened and forming a suction chamber during the suction phase.

It is endeavoured to improve the thermodynamic conditions during compression of a compressible medium.

For this purpose, for the duration of the suction phase, the suction chamber is reduced by a volume limiting element in such a way that at the end of the suction phase the chamber has a volume of at least 90% of a maximum volume appearing during the suction phase.

15 Claims, 8 Drawing Sheets

METHOD AND SCROLL COMPRESSOR FOR COMPRESSING A COMPRESSIBLE MEDIUM

CROSS REFERENCE TO RELATED APPLICATIONS

This application claims priority to German Patent Application No. 101 03 775.9 filed on Jan. 27, 2001 and assigned to the assignee of the present application, the disclosure of which is incorporated herein by reference.

FIELD OF THE INVENTION

The present invention is generally related to compressors and their use and is more specifically related to a scroll compressor having two displacement elements and a method for using such a compressor.

BACKGROUND OF THE INVENTION

The invention relates to a method for compressing a compressible medium, in which at least two displacement elements, each having at least one limiting face extending helically in the cross section, are orbited in relation to each other under formation of at least one chamber, the volume of the chamber being changed by the orbiting movement, performing a cycle with a suction phase, a compression phase and a discharge phase, the chamber being opened and forming a suction chamber during the suction phase. Further, the invention relates to a scroll compressor with at least two displacement elements operating in relation to each other with an orbiting movement, each having at least one limiting face extending helically in the cross section, the displacement elements forming at least one chamber, which, during the orbiting movement by way of a cycle with a suction phase, a compression phase and a discharge phase has a variable volume, the chamber having during the suction phase a suction chamber with at least one suction opening.

A compressor of this kind is known from U.S. Pat. No. 4,781,549. This document shows a scroll compressor with two orbiting displacement elements, each being limited in the cross section, both inside and outside, by a helically extending limiting face. Both displacement elements have a length of approximately $2\pi$ in the arc measure. Further, an inner profile end portion of the two displacement elements continuously extends its profile thickness. Together, the displacement elements form at least two chambers. Each chamber performs a cycle with a suction phase, a compression phase and a discharge phase. During the suction phase, the chamber has a suction opening, which is closed again at the end of the suction phase. Subsequently, the compression phase of the chambers starts. Shortly after the start of the compression phase, the chambers are united to form one chamber. The circulation length of a complete cycle amounts to approximately $4\pi$ in the arc measure.

U.S. Pat. No. 4,527,964 shows a scroll compressor, in which a displacement element extends helically over a length of approximately $3\pi$ in the arc measure and is orbited in relation to a second displacement element. Both displacement elements have limiting faces, which deviate from a regular helical shape. The moving displacement element has a long outer section with a small curvature. Due to the geometry of the displacement elements, a relatively large backflow to the suction side is generated at the end of the suction phase of this scroll compressor.

U.S. Pat. No. 6,099,279 shows a scroll compressor, whose displacement elements have several helical limiting faces. These also cause a relatively large backflow at the end of a suction phase because of their geometry.

EP 0 069 531 shows a scroll compressor with two displacement elements having a length of less than $3\pi$ in the arc measure. A relatively large backflow is also generated with this invention, as each displacement element has a long, slightly curved outer section.

Also DE 196 03 110 A1 shows a scroll compressor, whose displacement elements have relatively long, slightly curved outer sections.

Further, from, for example, U.S. Pat. Nos. 5,938,417, 5,547,353, 5,836,752, 3,884,599, 5,318,424, DE 42 15 038 and from the article "Der Scroll von Bock" (H. Kaiser, Die Kälte und Klimatechnik, Heft June 1993, pages 334 to 342), scroll compressors are known, which all have displacement elements with a length of approximately $3\pi$ in the arc measure. Further, the displacement elements have slightly curved and regular outer sections.

The extension of the helical limiting faces of the displacement elements of such scroll compressors is substantially based on a production-technical point of view. Due to the geometry of the helical limiting faces, however, a relatively large backflow from the chamber through the suction opening will be generated at the end of a suction phase. Thus, the scroll compressor loses both capacity and efficiency.

Based on the foregoing, it is the general object of the present invention to improve the thermodynamic conditions during compression of a compressible medium.

SUMMARY OF THE INVENTION

With a method as mentioned in the introduction, the present invention provides that for the duration of the suction phase, the suction chamber is reduced by a volume limiting element in such a way that at the end of the suction phase the chamber has a volume of at least 90% of a maximum volume occurring during the suction phase.

Besides being influenced by the helical limiting faces of the displacement element, the volume of the chamber is also influenced by the volume-limiting element. Thus, for example, the adaptation of the chamber volume to a predetermined volume function is possible. During the whole suction phase, the chamber volume can be changed in such a way that it has approximately its maximum volume when the suction opening closes. In this way a favourable volume relation is achieved between the maximum chamber volume and the chamber volume at the time when the suction opening closes. Consequently, only a small backflow from the chamber occurs at the end of the suction phase. This results in good thermodynamic conditions and thus higher efficiency, and a high capacity in relation to the overall size of the compressor. Accordingly, a given overall size of the compressor results in a relatively large suction volume and therefore a large mass flow through the compressor.

It is an advantage of the present invention that the volume of the chamber is reduced by the volume-limiting element over a predetermined circulation length from the beginning of the compression phase. The chamber volume is controllable during the compression phase. In this connection, the chamber volume can be adapted to a volume function over the circulation length, which function is particularly suited for the planned operation. This means that at the beginning of the compression phase a heavier reduction of the volume (relative compression) is possible than at the end of the compression phase.

It is advantageous that the reduction of the volume of the chamber by the volume limiting element from the beginning of the compression phase is finished at the latest after a predetermined circulation length of $1\pi$ in the arc measure. In this way, a smaller reduction of the volume can be achieved, resulting in a slow discharge. The slow discharge of the gas prevents pressure peaks on the pressure side.

It is particularly advantageous that the suction opening is closed before the end of a discharge phase. Thus, it is prevented that at the end of a suction phase effects on the flow conditions in one chamber will have a damaging influence on another chamber. Particularly, a reduction of the gas quantity sucked in through re-expansion of compressed gas is prevented, which would occur, if the suction opening did not close until after the end of the discharge phase. Thus, it is an advantage of the present invention that the displacement elements do not separate at the inner ends, until the suction opening is closed again at the outer end. This is accomplished because at least one of the displacement elements has a profile back, which projects into the suction chamber.

Thus, the profile back forms a volume-limiting element. For this purpose, each displacement element has a section, which is formed independently of a helical shape. By means of this section, the volume of the chamber can be adapted to a predetermined volume function, which is desired for process reasons. In this way, for example, a favourable volume relation between the maximum chamber volume and the chamber volume at the end of the suction phase can be realised. This again results in a smaller backflow during closing of the suction opening. In this way, a higher capacity and efficiency of the scroll compressor can be obtained.

Further, it is another advantage of the present invention that for a predetermined circulation length at the beginning of the compression phase, the profile back projects into the chamber. In this way, the progress of the compression phase can also be influenced through the embodiment of the profile back. This means that during the compression phase a predetermined change of the chamber volume can be set. For example, it is possible to generate a larger volume reduction at the beginning of the compression phase than at the end of the compression phase. This can reduce the compression phase, which leads to reduced leakage losses between the displacement elements.

It is favourable that the predetermined circulation length from the beginning of the compression phase amounts to a maximum of $1\pi$ in the arc measure. In this way, a smaller volume reduction and a slow discharge of the compressed gas at the end of the compression phase can be achieved.

It is still another advantage of the present invention that the profile back can rest on an outer profile end portion, which is adapted to the shape of the profile back. This cooperation during a bearing phase of the profile back with a counter piece adapted to it ensures a stable contact between the two displacement elements concerned. Further, this ensures regular flow conditions inside the chamber.

Further, it is favourable that the outer profile end portion has three sections, of which a second section, seen from an outer end, has a larger curvature than a first and a third section. In this connection, the slightly curved outer section ensures a closing of the suction opening in the proximity of the maximum chamber volume. By means of the more heavily curved section, being arranged between two slightly curved sections, also the backflow is reduced. Thus, an improvement of the closing behaviour of the suction opening is achieved.

Further, it is advantageous that the first and the second sections each have a length of approximately $\pi/3$ in the arc measure. Through these relatively short outer sections, the chamber portion, through which a backflow can occur, is kept relatively small. In this way, the backflow can be reduced.

It is favourable that the profile back has a larger curvature on the outer limiting face than on the inner limiting face. In this way it is possible that, during a cycle of the scroll compressor, a contact point on the outer side of the profile back moves in another track than a contact point on the inner side of the profile back. Thus, an improved adaptation of different chambers in different phases to a predetermined volume function is possible.

It is advantageous that over a predetermined circulation length the profile back of one of the displacement elements on the inner limiting face has a contact point with an inner end of the other displacement element. This enables the stable creation of a chamber inside the scroll compressor.

Further, it is advantageous that in the cross section at least one of the displacement elements has at least two part elements, which are unmovable in relation to each other. This makes it possible to increase the number of chambers in a scroll compressor. In this way, the compression processes in different stages can take place in parallel within the scroll compressor. This improves the running smoothness of the compressor operation.

Further, it is advantageous that at least two of the part elements are connected with each other. Thus, a good mutual timing of the compression processes in different chambers can be ensured.

BRIEF DESCRIPTION OF THE DRAWINGS

In the following, the invention is described on the basis of preferred embodiments in connection with the drawings, showing.

DETAILED DESCRIPTION OF THE PREFERRED EMBODIMENT

Figure 1:
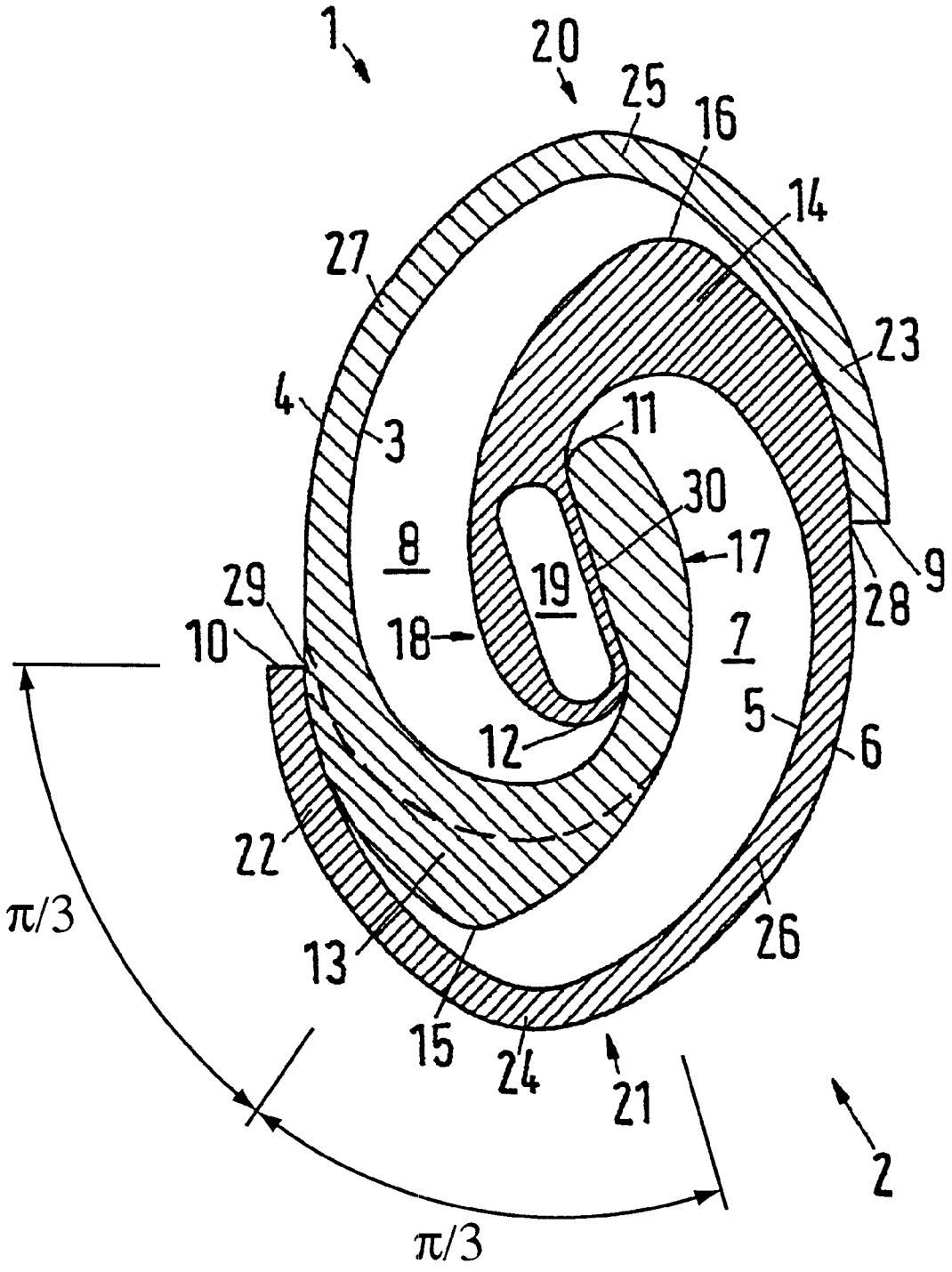
FIG. 1 is a cross sectional view of the displacement elements of a scroll compressor having two displacement elements.

FIG. 1 shows two displacement elements 1, 2 of a scroll compressor. Both displacement elements 1, 2 are limited inwardly by an inner limiting face 3, 5 and outwards by an outer limiting face 4, 6. Both the inner limiting faces 3, 5 and the outer limiting faces 4, 6 have a helical cross section.

Here, "helical" means a smooth curve, whose distance from a centre point is reduced from an outer end 9, 10 towards an inner end 11, 12. In this connection, the curvature of the curve as a whole increases from the outside towards the inside. However, sections of the curve may have a constant or increasing curvature.

The arc lengths of both displacement elements 1, 2 are greater than approximately 2π, however, not more than approximately 3π, in the arc measure.

Seen from the outer end 9, 10 both displacement elements 1, 2 have a substantially constant profile thickness over a profile end portion 20, 21. Subsequently, the profile thicknesses of both displacement elements 1, 2 increase in the area of a profile back 13, 14 until reaching a back apex 15, 16, and then the profile thicknesses decrease again. In the direction of the inner end 11, 12 of both displacement elements 1, 2 an inner profile end portion 17, 18 follows the area of the profile back 13, 14. In these profile end portions 17, 18, the profile thickness of the displacement elements 1, 2 first increase again, then decrease again towards the inner end 11, 12.

The term "profile back" 13, 14 here comprises a profile section of the displacement element 1, 2 in question between the inner limiting face 3, 5 and the outer limiting face 4, 6. Thus, the term "profile back" also comprises a lateral bulging. The function of the two displacement elements 1, 2 during a complete cycle is described in the FIGS. 2*a* to 2*f*.

In its inner profile end portion 18, the displacement element 2 has a discharge chamber 19. This discharge chamber 19 is connected with a discharge opening (not shown), which extends from the inner limiting face 5 of the displacement element 2 to the discharge chamber 19. Further, the discharge chamber 19 has a connection to a discharge path of the scroll compressor. In a manner not shown, the discharge of gas can also take place in an axial direction, for example through a hole in a bottom portion (not shown) of the compressor.

Further, a pressure controlled discharge valve (not shown) is typically located in the discharge opening. By means of this discharge valve, the discharge opening is closed when the opening pressure is below a predetermined value.

In the direction of their outer ends 9, 10 each displacement element 1, 2 has the outer profile end portion 20, 21. Seen from the outer end 9, 10 both outer profile end portions 20, 21 have a first section 22, 23, a second section 24, 25 and a third section 26, 27. In this connection, each second section 24, 25 has a greater curvature than each first section 22, 23 and each third section 26, 27. The sections 22, 23, 24, 25 each have an arc length of approximately π/3, whereas the sections 26, 27 have a larger arc length than π/3, for example ½ to ¾π.

Both displacement elements 1, 2 bear on one another a two contact points 28, 29 and along a contact line 30. The terms "contact point" and "contact line" here refer to the cross-sectional view. In fact, the two contact points 28, 29 comprise an approximately line-shaped contact area and the contact line 30 comprises a contact face.

FIG. 2 shows the displacement elements 1, 2 in different positions, which they assume in the course of a part (approximately one half) of a cycle. FIG. 2 describes the compression and discharge phase. At the same time, the suction phase of the next cycle occurs, so that FIG. 2 practically shows a complete cycle.

Figure 2A:
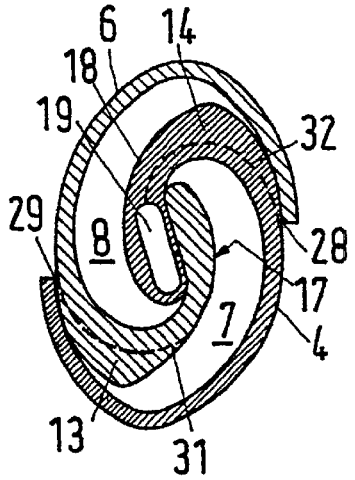
FIGS. 2*a* to 2*f* are cross-sectional views of the displacement elements of FIG. 1 shown at different points in a cycle.

At a starting time, the two displacement elements 1, 2 are positioned relative to one another as shown in FIG. 2*a*. Here, it must be noted that each of the constellations of the displacement elements 1, 2 shown in the FIGS. 2*a* to 2*f* is continuously performed in cycles following each other. Any of the constellations in FIGS. 2*a* to 2*f* could be used as constellation at the starting time.

In FIG. 2*a*, the two displacement elements 1, 2 of the scroll compressor form two chambers 7, 8. Each chamber is closed towards the outside by one of the contact points 28, 29. The inner profile end portions 17, 18 of the two displacement elements 1, 2 bear on one another along the contact line 30. Thus, the discharge opening (not shown) to the discharge chamber 19 is closed by the inner profile end portion 17 of the displacement element 1. Further, dotted auxiliary lines 31, 32 have been drawn. These lines show the assumed extension of the outer limiting face 4, 6 over the area of the profile back 13, 14 in question, assuming that the profile thickness of the two displacement elements 1, 2 is constant. Related to the auxiliary line 31, 32 in question, the profile back 13 clearly projects into the chamber 7 and the profile back 14 clearly projects into the chamber 8.

Figure 2B:
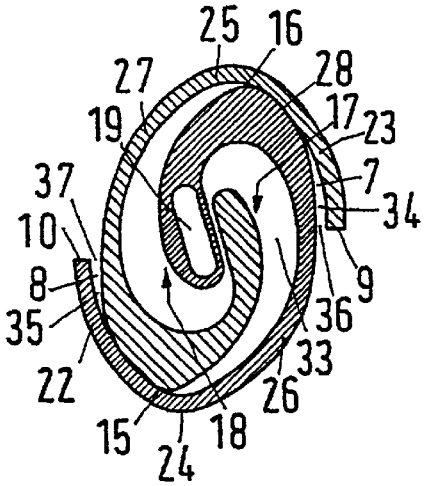

FIG. 2*b* shows the constellation of the two displacement elements 1, 2 after a certain orbiting movement in relation to FIG. 2*a*. In the present case the displacement element 2 is fixedly supported, whereas the displacement element 1 is supported to be orbiting. Alternatively, a movable displacement element 2 and a fixedly supported displacement element 1 is also possible. Further, also both displacement elements 1, 2 can be movably supported.

In FIG. 2*b*, the two displacement elements 1, 2 no longer have a contact line 30. On the contrary, the two chambers 7, 8 are in fluid communication with one another to create one chamber 33. Further, the not shown discharge opening in the inner profile end portion 18 of the displacement element 2 is no longer closed by the inner profile end portion 17 of the displacement element 1. At this time, the discharge opening is still closed by the pressure controlled discharge valve (not shown). Therefore, the chamber 33 still has no connection with the discharge chamber 19 via the discharge opening.

In relation to their position in FIG. 2*a*, the contact points 28, 29 have travelled further inwards, away from the related outer end 9, 10. This means that the contact points 28, 29 are formed on the inner limiting face 3, 5 in a transition area from the first section 22, 23 to the second section 24, 25 and on the related outer surface 4, 6. On each outer end 9, 10 of the two displacement elements 1, 2 a new suction chamber 34, 35 with a suction opening 36, 37 is formed. Thus, the suction chambers 34, 35 form two new chambers 7, 8 for the next suction cycle, which are in a suction phase. At the same time, the chamber 33 is in a compression phase.

Figure 2C:
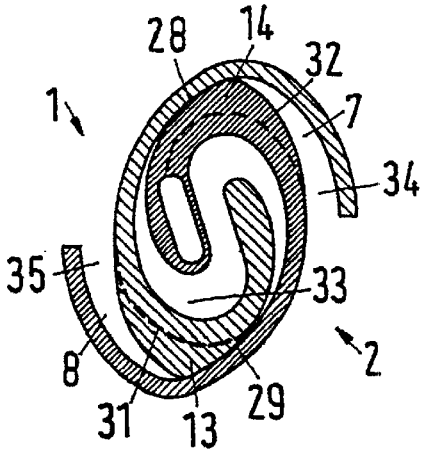

FIG. 2*c* shows the constellation of the displacement elements 1, 2 after a further relative movement. Now, in relation to FIG. 2*b*, the suction chambers 34, 35 of the chambers 7, 8 have a larger volume. On the other hand, the volume of the chamber 33 is smaller in relation to that shown in FIG. 2*b*. Related to the auxiliary lines 31, 32, the profile backs 13, 14 project clearly into the related suction chambers 34, 35 of the chambers 7, 8 in the suction phase. Again, the contact points 28, 29 have moved further inward, away from the outer ends 9, 10.

Figure 2D:
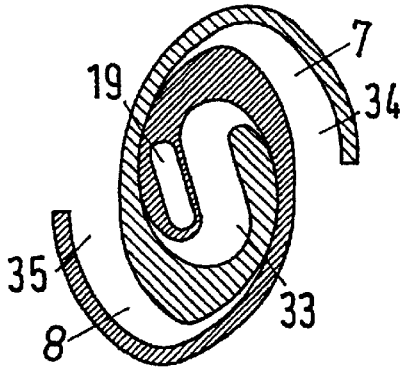
Figure 2E:
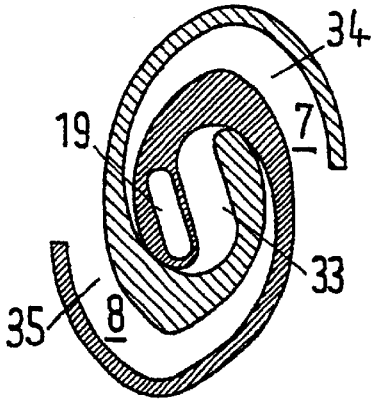
Figure 2F:
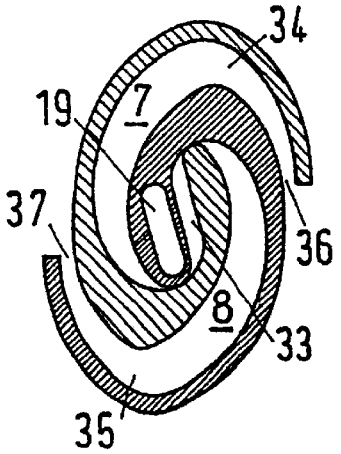

In the FIGS. 2*d* to 2*f*, the volume of the chamber 33 decreases more and more. Thus, the compressible medium contained in the chamber 33 is increasingly compressed. As soon as the pressure in the chamber 33 reaches a predetermined opening pressure, the discharge valve on the discharge opening opens. This means that the compressible medium can flow from the chamber 33 through the discharge opening into the discharge chamber 19 and further into the discharge path of the scroll compressor. On the other hand, the volume of the chambers 7, 8 in the suction phase increases further at the times shown in the FIGS. 2*d* to 2*f*. Thus, the compressible medium is continuously sucked into the suction chambers 34, 35. At the end of the suction phase, the suction openings 36, 37 of the suction chambers 34, 35 are closed again. This means that, as shown in FIG. 2*a*, the outer ends 9, 10 are brought to bear on the respective outer limiting face 4, 6 of the other displacement element 1, 2 again. At this time, the suction phase of the chambers 7, 8 is finished.

Figure 3:
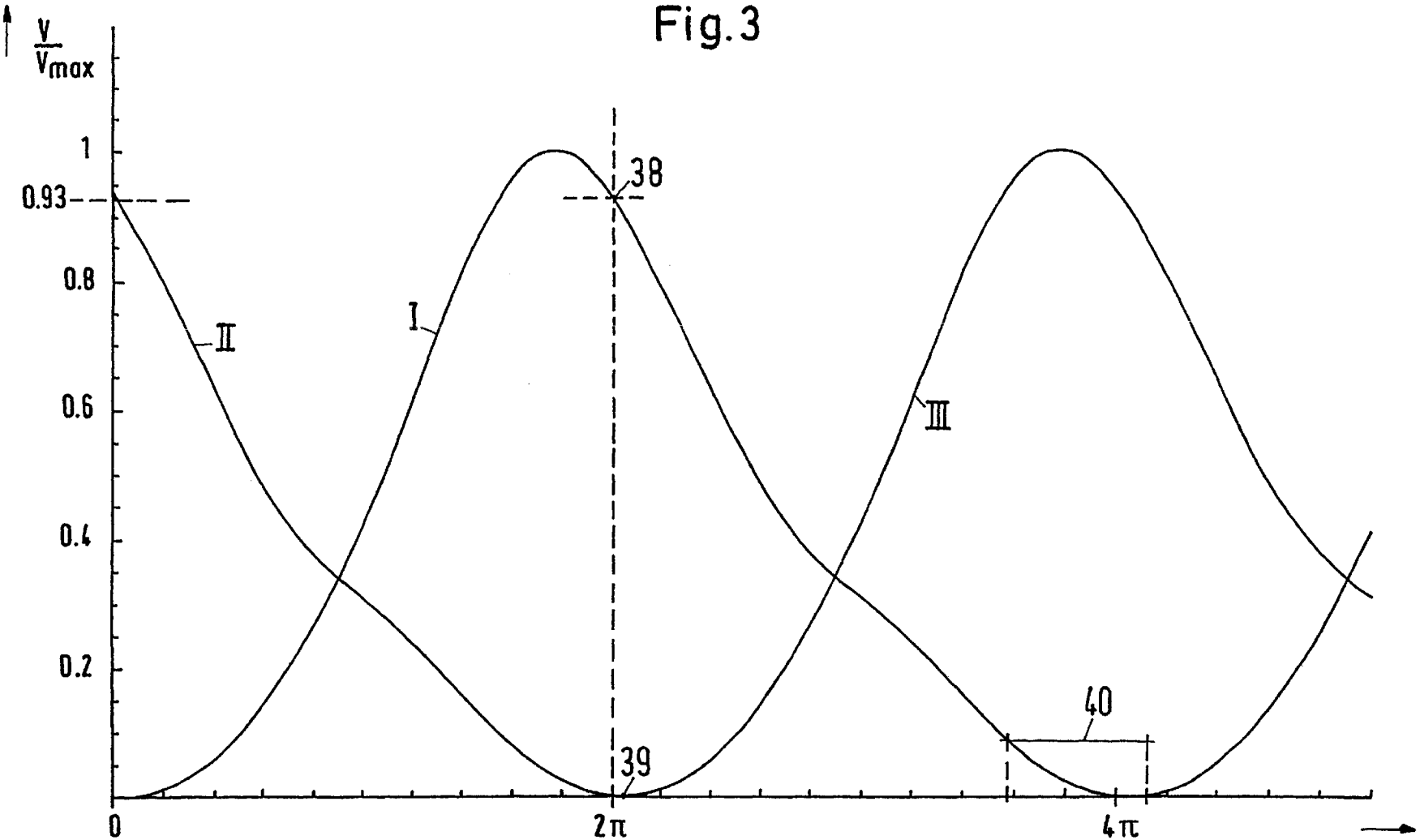
FIG. 3 is a graphical representation of the volume ratios of the chambers according to the FIGS. 2*a* to 2*f* during a cycle.

FIG. 3 shows the course of the volume ratios (volume function) of the chambers shown in the FIGS. 2*a* to 2*f*. In this connection, the volume ratio is determined as a quotient of the momentary volume of a chamber to the maximum volume of the chamber. The curves shown here correspond to a course of the volume ratios of the chambers during a cycle, which is considered favourable. By means of these volume functions, the profile thicknesses over the whole lengths of the two displacement elements 1, 2 were determined. Particularly, the profile backs 13, 14 were formed in dependence of these volume functions. In this way it is possible to adapt the chambers of the scroll compressor during the compression phase and the suction phase to the respectively desired volume change.

From the volume function it appears that a complete cycle I, during which a chamber passes a compression phase and a suction phase, has a circulation length of approximately 4.1π in the arc measure. Further, it can be seen from the diagram in FIG. 3 that a discharge phase 40 of the previous cycle II appears only shortly after the end of the parallel suction phase 38 of the cycle I. In this way it is prevented that possible disturbances at the end of the discharge phase of a chamber has a disturbing influence on the suction volume of the following chamber.

Further, a discharge phase 40 is shown, during which the discharge valve is open.

The length of the valve-opening phase 40 depends on the ruling pressure ratio between the suction pressure and the discharge pressure.

Further, it can be seen from the diagram shown that the volume relation of the chambers 7, 8 at the end of the suction phase 38 in the present embodiment has a value of approximately 0.93. At any rate, the volume relation should never be lower than 0.9.

Figure 4:
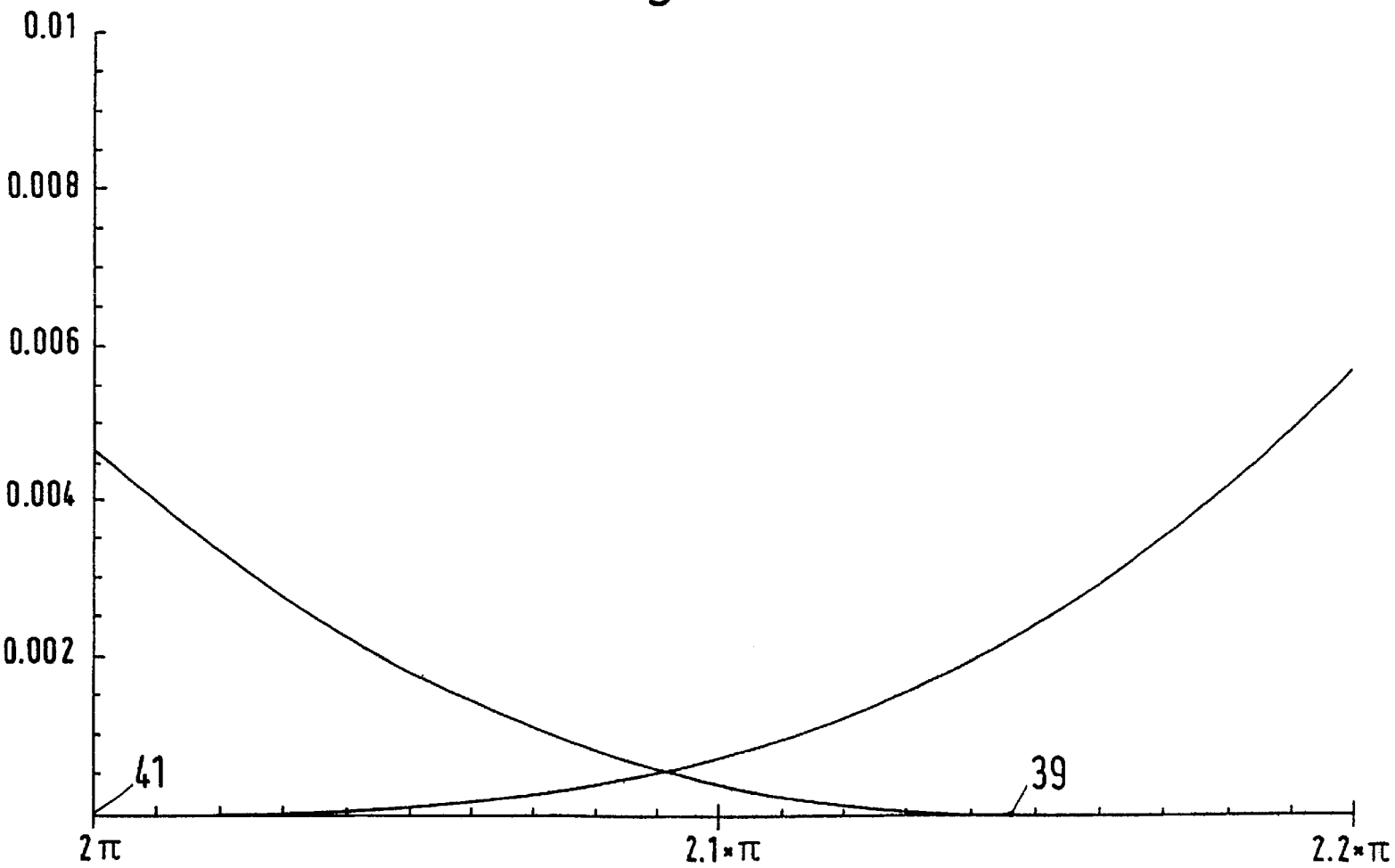
FIG. 4 is an enlarged section of the diagram according to FIG. 3 at the end of a discharge phase.
Figure 5A:
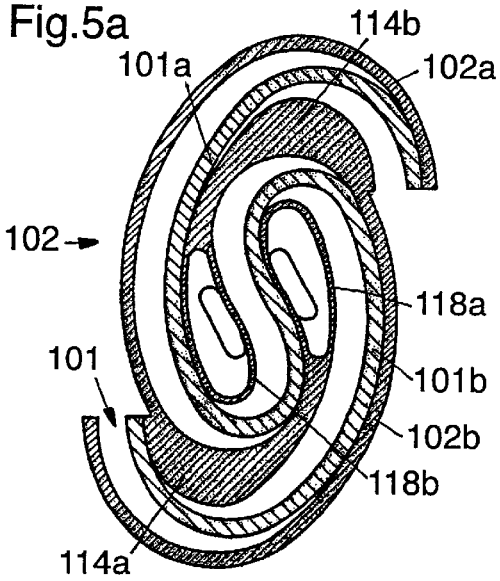
FIGS. 5*a* to 5*f* are cross-sectional views of the displacement elements of a scroll compressor with four part elements at different times of part of a cycle.
Figure 5B:
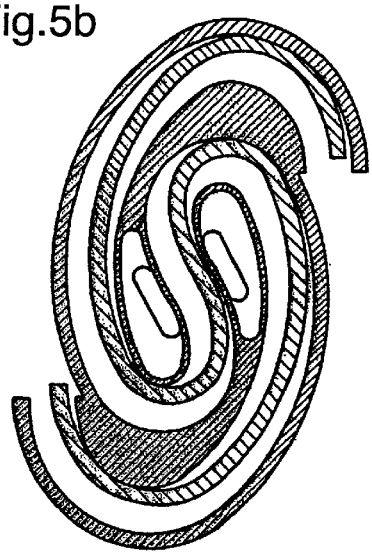
Figure 5C:
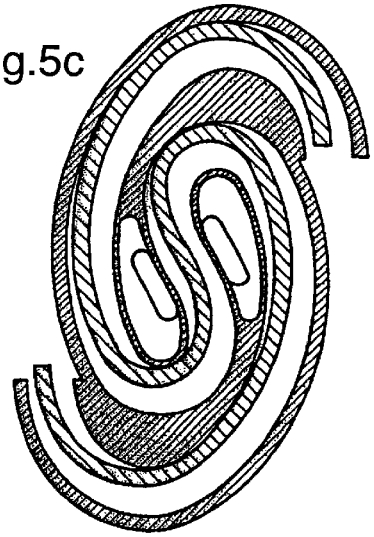
Figure 5D:
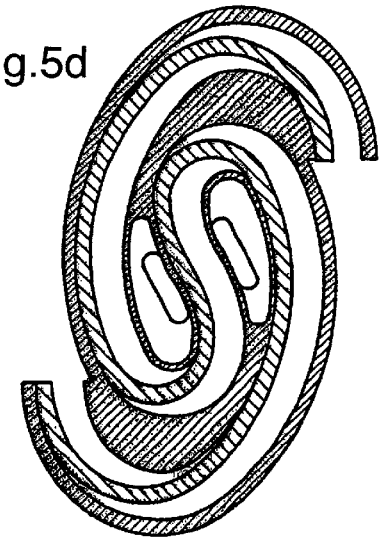
Figure 5E:
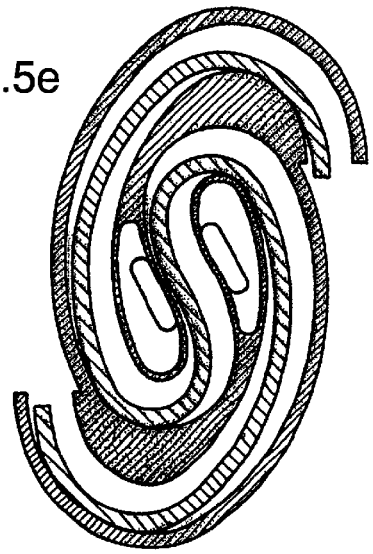
Figure 5F:
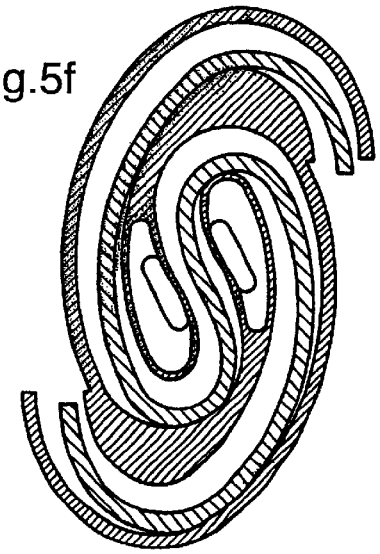

FIG. 4 shows the end of the discharge phase 39 of the cycle II in an enlarged section of FIG. 3. From this it can be seen that the end of the discharge phase 39 occurs only after a circulation length between 2.1 and 2.2π in the arc measure. On the other hand, the start of a new suction phase 41 of a new cycle III starts already after a circulation length of exactly 2π.

The FIGS. 5*a* to 5*f* show different constellations of the displacement elements 101, 102 of a scroll compressor with two movable part elements 101*a*, 101*b* and two fixed part elements 102*a*, 102*b* of the displacement element 102. Parts corresponding to the parts in FIGS. 1 and 2 have reference numbers increased by 100. The two fixed part elements 102*a*, 102*b* are turned in relation to each other by an angle of 180° and twisted in each other. The movable part elements 101*a*, 101*b* of the displacement element 101 are arranged between the fixed part elements 102*a*, 102*b*. Also the movable part elements 101*a*, 101*b* are turned in relation to each other by an angle of 180°. Contrary to the fixed part elements 102*a*, 102*b*, the two movable part elements 101*a*, 101*b* are connected with each other, thus forming an integral element. Over its whole length, this element has a substantially constant profile thickness. On the other hand, corresponding to the displacement element 2 according to FIGS. 1 and 2*a* to 2*f*, the fixed part elements 102*a*, 102*b* are provided with a profile back 114*a*, 114*b* and an inner profile end portion 118*a*, 118*b*. Also otherwise, the design and the mode of operation of the fixed part elements correspond to those of the displacement element 2 according to FIGS. 1 and 2*a* to 2*f*. Thus, the statements above concerning the displacement element 2 also applies here.

Figure 6:
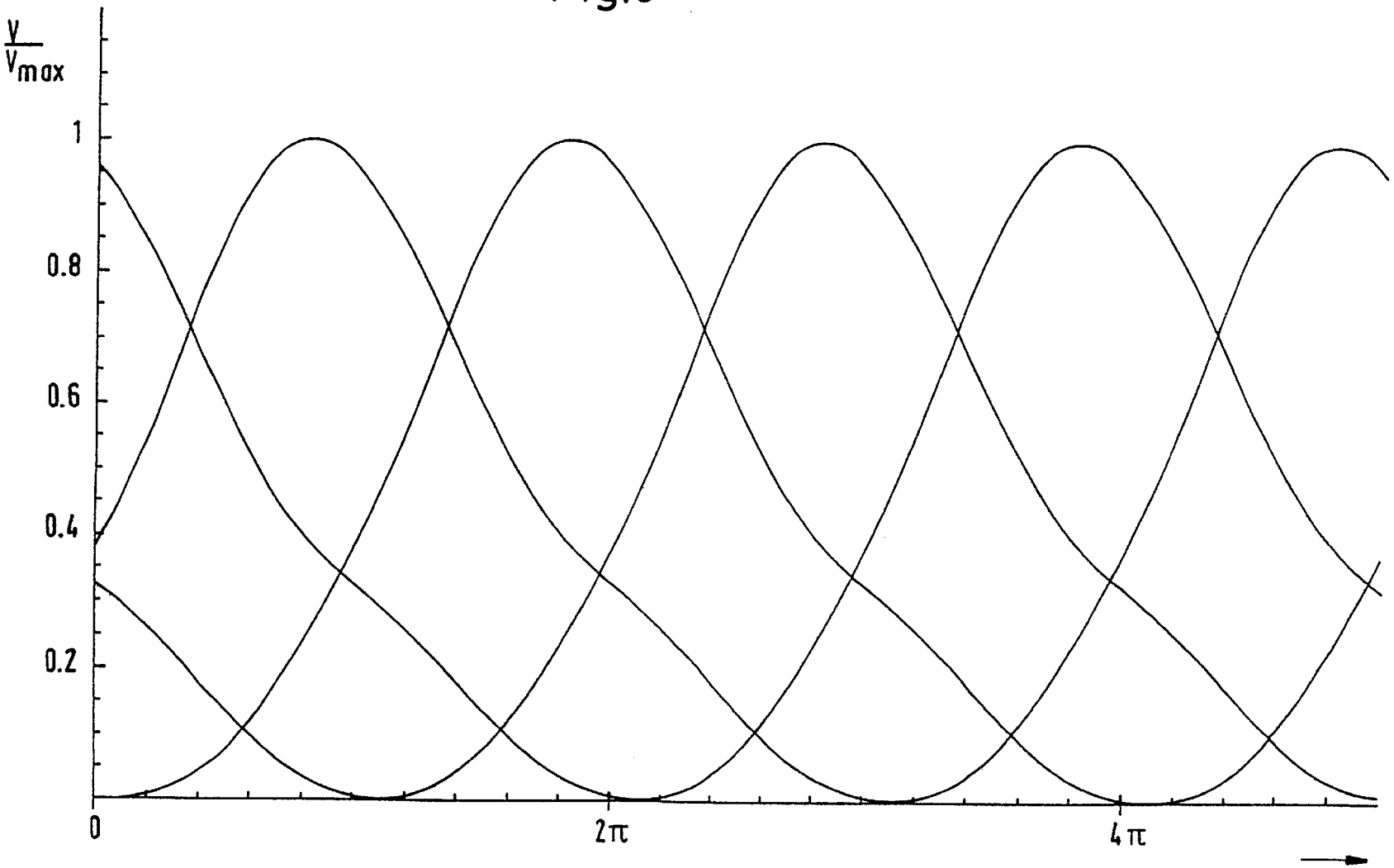
FIG. 6 is a graphical representation of the volume ratios of the chambers according to FIGS. 5*a* to 5*f* during a cycle.
Figure 7A:
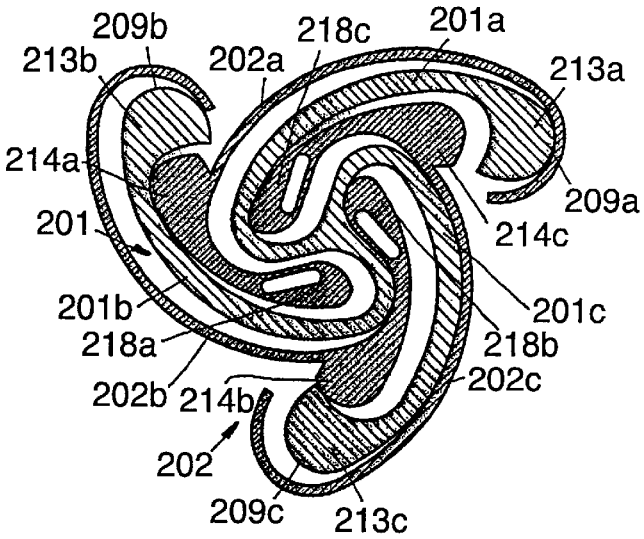
FIGS. 7*a* to 7*f* are cross-sectional views of the displacement elements of a scroll compressor with six part elements at different times of part of a cycle.
Figure 7B:
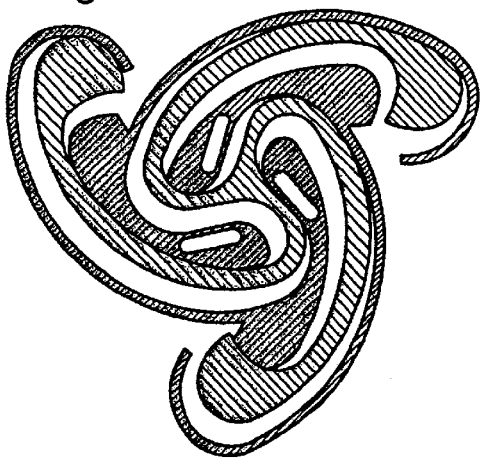
Figure 7C:
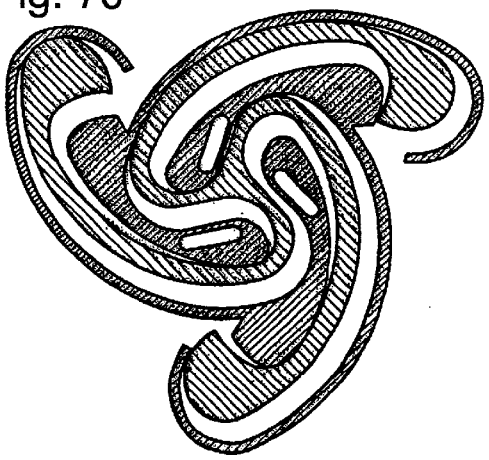
Figure 7D:
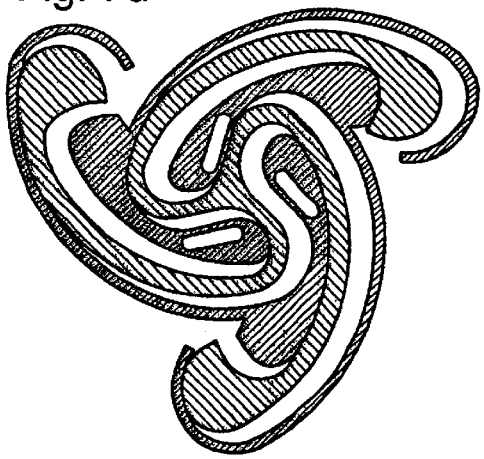
Figure 7E:
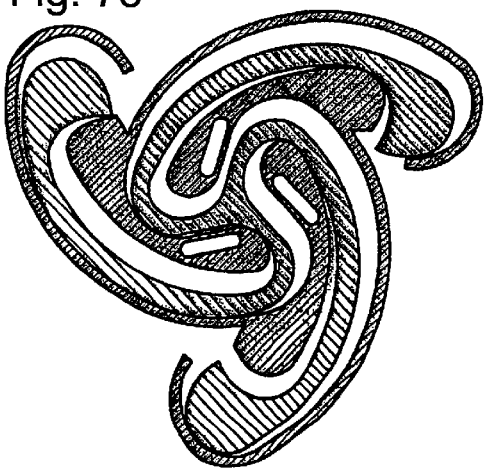
Figure 7F:
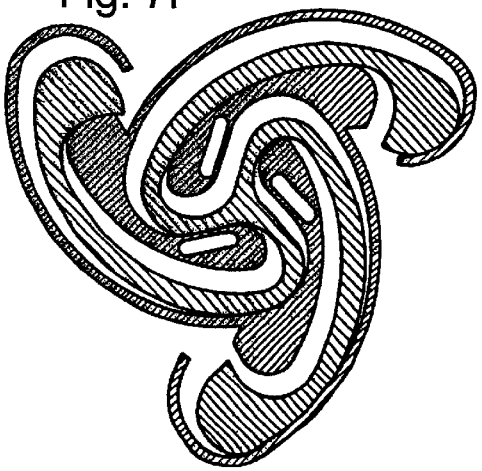

FIG. 6 shows the volume ratios of the chambers corresponding to an embodiment according to FIGS. 5*a* to 5*f*. Here, it can be seen that during a complete cycle with a circulation arc length of approximately 4π, an embodiment according to FIGS. 5*a* to 5*f* has four compression phases and four suction phases. As opposed to this, the embodiment with only two displacement elements according to FIG. 1 has only two compression phases and two suction phases during a complete cycle.

Due to this higher number of compression processes, the compression with an embodiment according to the FIGS. 5*a* to 5*f* will be smoother. Only slight pulsations occur both on the suction side and on the discharge side, and the compressor as a whole will operate more smoothly. This embodiment also ensures a reduced orbiting radius of the movable displacement element 101, which causes reduced frictional losses and an increased stability of the movable compressor parts.

The FIGS. 7*a* to 7*f* show different constellations of the displacement elements 201, 202 of a scroll compressor with three movable part elements 201*a*, 201*b*, 201*c* and three fixed part elements 202*a*, 202*b*, 202*c*. Parts corresponding to those in FIGS. 1 and 2 have reference numbers increased by 200. In this embodiment, the fixed part elements 202*a*, 202*b*, 202*c* of the displacement element 202 are turned in relation to each other by and angle of 120° and twisted in each other. The movable part elements 201*a*, 201*b*, 201*c* of the displacement element 201 are also turned in relation to each other by and angle of 120° and connected to form a integral element. In this connection, the movable part elements 201*a*, 201*b*, 201*c* have on their respective outer ends 209*a*, 209*b*, 209*c* a profile back 213*a*, 213*b*, 213*c*. On this profile back 213*a*, 213*b*, 213*c* the profile thickness is heavily expanded in relation to the remaining part of the respective part elements 201*a*, 201*b*, 201*c*.

Like the displacement element 1, 2 according to FIGS. 1 and 2*a* to 2*f*, the fixed displacement elements 202*a*, 202*b*, 202*c* have a profile back 214*a*, 214*b*, 214*c* and an inner profile end portion 218*a*, 218*b*, 218*c*. Also otherwise, the design and the mode of operation of the fixed part elements 202*a*, 202*b*, 202*c* correspond to those of the displacement element 2 in FIGS. 1 and 2*a* to 2*f*. Thus, the statements above concerning the displacement element 2 also apply here.

Figure 8:
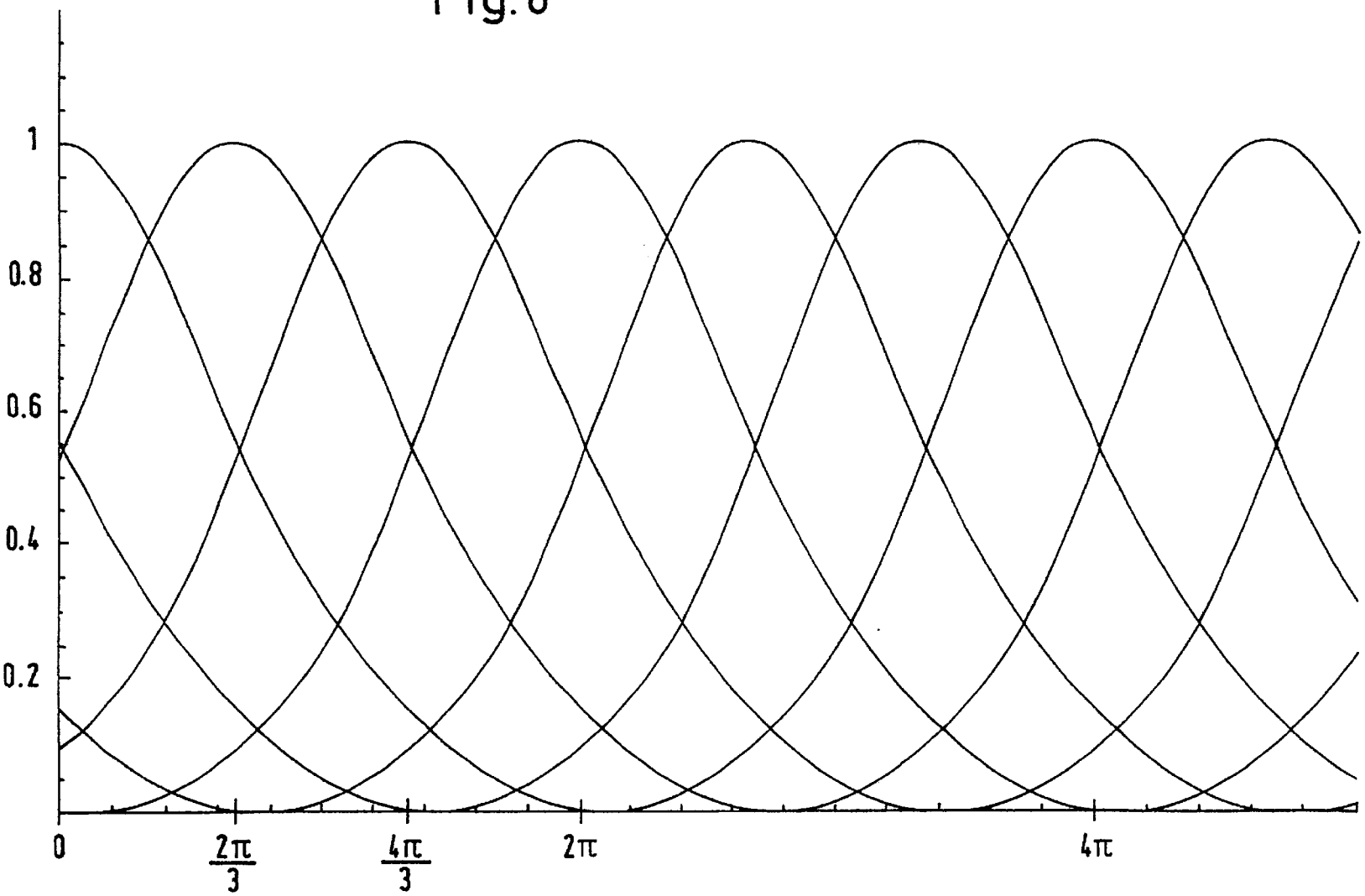
FIG. 8 is a graphical representation of the volume ratios of the chambers according to FIGS. 7*a* to 7*f* during a cycle.

FIG. 8 shows the volume ratios of the chambers in an embodiment according to the FIGS. 7*a* to 7*f* during a cycle. It can be seen that during a cycle with a circulation length of approximately 4π in the arc measure, six suction phases and six compression phases are passed. In this way, an embodiment according to the FIGS. 7*a* to 7*f* ensure a further smoothing of the compression of a medium and an increased running smoothness of the compressor operation.

What is claimed is:

1. A method for compressing a compressible medium comprising:

providing a compressor having at least two displacement elements each of which defines a helical outer and a helical inner limiting face, at least one displacement element being orbitally movable relative to the other, thereby forming at least one chamber defining a volume that is changeable with the relative movement of the displacement elements, one to the other, said displacement elements each further defining a profile back, each profile back being cooperable with one of said helical inner limiting faces;

causing relative motion to occur between the at least two displacement elements to accomplish at least one compressor cycle having a suction phase, a compression phase, and a discharge phase;

forming a suction chamber during said suction phase, said suction chamber defining a suction chamber volume; and causing said volume of said at least one chamber to reduce during said suction phase such that upon completion thereof said suction chamber volume is at least about 90% of a maximum volume occurring during said suction phase.

2. A method according to claim 1, further comprising the step of reducing said volume over a predetermined circulation length from the start of the compression phase.

3. A method according to claim 1, wherein said reduction of said volume of said chamber from the beginning of said compression phase is finished at least after a predetermined circulation arc length of about $1\pi$.

4. A method according to claim 1, wherein said compressor includes a suction opening movable between an open and closed position, the method further including the step of closing the suction opening prior to completion of a discharge phase.

5. A scroll compressor comprising;

at least two displacement elements at least one of which is orbitally movable relative to the other;

each of the at least two displacement elements defining at least one helically extending limiting face;

the displacement elements cooperating to form at least one chamber during operation of the scroll compressor through a suction phase, a compression phase, and a discharge phase;

the chamber defining a volume that is variable during operation of the scroll compressor;

the chamber comprising during said suction phase a suction chamber having at least one opening;

at least one of the displacement elements having a profile back that projects into the suction chamber and is engagable with one of the helically extending limiting faces.

6. A scroll compressor according to claim 5, wherein for a predetermined circulation length at the beginning of the compression phase, the profile back projects into the chamber.

7. A scroll compressor according to claim 6, wherein a predetermined circulation length from the beginning of the compression phase amounts to a maximum arc length of about $1\pi$.

8. A scroll compressor according to claim 5, wherein the profile back can rest on an outer profile end portion, which is adapted to the shape of the profile back.

9. A scroll compressor according to claim 8, wherein the outer profile end portion has three sections, of which a second section, seen from an outer end, has a larger curvature than a first section and a third section.

10. A scroll compressor according to claim 9, wherein the first section and the second section each have an arc length of approximately $\pi/3$.

11. A scroll compressor according to claim 5, wherein the profile back has an outer and inner limiting face and define a larger curvature on the outer limiting face than on the inner limiting face.

12. A scroll compressor according to claim 11, wherein over a predetermined circulation length the profile back of one of the displacement elements on the inner limiting face has a contact point with an inner end of the other displacement element.

13. A scroll compressor according to claim 5, wherein at least one of the displacement elements has at least two part elements, which are unmovable in relation to each other.

14. A scroll compressor according to claim 13, characterised in that at least two of the part elements are connected with each other.

15. A scroll compressor comprising;

at least two displacement elements at least one of which is orbitally movable relative to the other;

each of the at least two displacement elements defining at least one helically extending limiting face;

the displacement elements cooperating to form at least one chamber during operation of the scroll compressor through a suction phase, a compression phase, and a discharge phase;

the chamber defining a volume that is variable during operation of the scroll compressor;

the chamber comprising during said suction phase a suction chamber having at least one opening;

at least one of the displacement elements having a profile back that projects into the suction chamber, the profile back having an outer and inner limiting face and defining a larger curvature on the outer limiting face than on the inner limiting face, and wherein over a predetermined circulation length the profile back of one of the displacement elements on the inner limiting face has a contact point with an inner end of the other displacement element.

* * * * *